US008827756B2

(12) United States Patent
Mueller

(10) Patent No.: US 8,827,756 B2
(45) Date of Patent: Sep. 9, 2014

(54) ELECTRICAL TERMINAL

(75) Inventor: Steffen Mueller, Nuremberg (DE)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 297 days.

(21) Appl. No.: 13/513,356

(22) PCT Filed: Dec. 3, 2009

(86) PCT No.: PCT/IB2009/056023
§ 371 (c)(1),
(2), (4) Date: Jun. 25, 2012

(87) PCT Pub. No.: WO2011/067632
PCT Pub. Date: Jun. 9, 2011

(65) Prior Publication Data

US 2012/0264340 A1 Oct. 18, 2012

(51) Int. Cl.
*H01R 11/22* (2006.01)
*H01R 13/11* (2006.01)
*H01R 13/187* (2006.01)

(52) U.S. Cl.
CPC ..... *H01R 13/114* (2013.01); *H01R 13/187* (2013.01)
USPC ..... 439/852

(58) Field of Classification Search
CPC ..... H01R 13/114; H01R 13/187
USPC ..... 439/852
See application file for complete search history.

(56) References Cited

U.S. PATENT DOCUMENTS

| | | | | |
|---|---|---|---|---|
| 3,713,080 | A | 1/1973 | Kennedy | 339/258 R |
| 3,786,401 | A | 1/1974 | Jones et al. | 339/258 R |
| 4,152,042 | A | 5/1979 | Ostapovitch | 339/258 R |
| 4,472,017 | A | 9/1984 | Sian | 339/217 S |
| 5,890,936 | A * | 4/1999 | McDonald et al. | 439/852 |
| 5,941,741 | A * | 8/1999 | Dobbelaere et al. | 439/852 |
| 6,450,843 | B1 * | 9/2002 | Heimuller | 439/852 |
| 7,485,016 | B2 * | 2/2009 | Ishigami | 439/851 |
| 7,530,859 | B2 * | 5/2009 | Moll et al. | 439/852 |
| 8,021,200 | B2 * | 9/2011 | Myer et al. | 439/857 |
| 2012/0315806 | A1 * | 12/2012 | Myer et al. | 439/861 |

FOREIGN PATENT DOCUMENTS

| | | | |
|---|---|---|---|
| DE | 44 42 765 | A1 | 6/1996 |
| DE | 10 2004 052 378 | B4 | 5/2006 |
| EP | 0 859 431 | A2 | 8/1998 |
| EP | 1 990 867 | A2 | 11/2008 |

* cited by examiner

*Primary Examiner* — Neil Abrams
(74) *Attorney, Agent, or Firm* — Robert J. Myers

(57) ABSTRACT

The present invention relates to a contact terminal for the reception of contact pins. The terminal includes a pin reception member having a box-shape made from a single piece of sheet metal, wherein two opposite walls include each at least one cut-out contact tongue being inwardly bent into the interior of the box-shape. Two other opposite walls include each a contact front portion which is inwardly bent such that the respective wall has essentially a hook-shaped cross-section to clampingly receive a contact pin.

13 Claims, 4 Drawing Sheets

ELECTRICAL TERMINAL

1. FIELD OF THE INVENTION

The invention relates to contact terminals for the reception of contact pins.

2. PRIOR ART

Contact terminals are used for a large number of applications as electrical contact means. They commonly consist of one or two pieces of sheet metal (of any suitable conductive material), which are stamped and bent into a desired shape. On one end the terminals are provided with holding or crimping means for the attachment of a cable or wire. The opposite end of the terminal is the actual contact portion and usually provided with a pin reception member in case of a female terminal or a contact pin in case of a male terminal.

Document DE 44 42 765 A1 describes a typical prior art contact terminal made from a piece of sheet metal being bent and stamped into a desired shape. The terminal is of unitary construction and comprises a box-shaped pin reception member on the one end adapted to receive a contact pin. The pin reception member is provided with spring or contact tongues which extend into the interior of the box-shaped pin reception member so that upon insertion of a contact pin into the reception member the spring or contact tongues will clampingly engage the contact pin and hold the same in the contact terminal.

Document EP 1 990 867 A2 discloses another electrical contact terminal made from two pieces of sheet metal. One piece is the actual contact terminal and the other piece is additionally provided in form of a holding cage around the pin reception member to increase the mechanical stability thereof. Also this terminal comprises different kinds of spring or contact arms inside of the box-shaped pin reception member which are arranged to be biased against an inserted contact pin to hold the same therein and to provide a suitable electrical contact between the terminal and the pin.

It is an object of the present invention to provide a contact terminal which provides a more reliable pin reception member, and for example suitable for applications in which a large number of contacts have to be mated in a single work step. It is a further object of the present invention to provide a contact terminal which facilitates the insertion of a contact pin into a pin reception member of the terminal and to reduce the number of defective products produced. Further, it is an object of the invention to achieve the advantages of a state-of-the-art products thought less expensive. It is also an object of the invention to make a product, which can preferably be made from a single piece of sheet metal, with an increased ratio of the number of products manufactured per stroke of stamping tool and which does preferably not require any additional holding elements or welding operations to function properly.

These and other objects, which become apparent upon reading the following description, at least one of these objects being solved by a contact terminal according to claim 1.

3. SUMMARY OF THE INVENTION

According to the invention a contact terminal for the reception of contact pins is provided, which comprises a pin reception member having essentially a four-wall box-shape made from a single piece of sheet metal. The sheet metal may be made of any suitable conductive metal (copper alloy, aluminum, etc.) Preferably, the box-shape is made of four walls being arranged substantially perpendicular with respect to each other, thereby forming a cylinder with rectangular cross-section being open at its two ends for the reception of the contact pin. Two opposite walls of the pin reception member comprise each at least one cut-out contact tongue, which is inwardly bent into the interior of the box-shape. The contact tongues are intended to contact a pin received in the pin reception member and preferably to also mechanically hold the contact pin therein. Each of the other two opposite walls of the four-wall box-shape comprises a contact front portion, which is inwardly bent in such a way that the respective wall has essentially a hook-shaped cross section. In other words, the front portion of the wall is for example provided in form of an elongated contact tongue, which is inwardly bent inside of the interior of the box-shape to provide an additional contact means for a contact pin. Preferably, at least one wall of the pin reception member comprises at least one aperture and another wall comprises at least one locking tongue, so that in the assembled condition of the reception member the locking tongue is arranged in said aperture to hold the box-shape together. Thereby, it is no longer necessary to secure the box-shape of the pin reception member by means of welding, since the locking tongue in cooperation with the aperture is sufficient to hold the pin reception member in its box-shape, even upon insertion of a contact pin therein. Preferably, the inwardly bent contact front portions as well as the cut-out contact tongues are adapted to provide contact surfaces for a contact pin and are further preferably adapted to also hold the contact pin.

In a preferred embodiment, the contact front portions as well as the cut-out contact tongues are provided in form of elastic spring arms. In this way a secure electrical contact as well as a secure mechanical fastening of a contact pin arranged inside of the pin reception member can be achieved. A particularly reliable connection can be achieved, if the contact elements provided on each of the four walls of the pin reception member are symmetrical with respect to the respective opposite contact element. In other words, the opposing contact elements—like the two cut-out contact tongues and the two contact front portions—are of similar shape and construction, so that the contact and holding force applied by these elements on an inserted contact pin are essentially identical. The cut-out contact tongues are preferably formed from a u-shaped cut-out in the walls of the reception member and directed opposite to the reception direction of the pin reception member. In the context of the present description the term "reception direction" is used to indicate the plug-in direction of a contact pin.

In a most preferred embodiment of the present invention the pin reception member comprises preferably four walls forming the box-shape, wherein the cut-out contact tongues and the contact front portions are associated with respective pairs of opposite walls. After a large number of experiments, applicants found that the pin insertion process can be highly facilitated and waste products can be reduced if the contact forces of the two pairs of contact elements differ from each other and when the pair with the lower contact force is arranged such that upon insertion of a contact pin into the pin reception member the pair with the lower contact force contacts the pin before the other pair. Thereby, the initial insertion of the pin is facilitated due to the lower resistance of the first pair of the contact tongues and the pin only engages the pair with the stronger contact force after the pin is to a certain extent guided by the other pair the pin reception member, whereby the risk that the pin is deflected upon insertion is highly reduced.

In a most preferred aspect of the invention the contact tongues as well as the contact front portions are provided in form of elastic spring arms, whereby one end of the arms is arranged on the respective wall of the reception member and the free end of the spring arm is arranged inside of the box-shape such that an inserted contact pin is contacted and preferably hold on four sides thereof. Applicants surprisingly found that a particular reliable connection can be achieved, if the free ends of the cut-out contact tongues are directed in a direction opposite to the direction of the free ends of the contact front portions. The positive effect can essentially be increased by providing the cut-out contact tongues with a larger spring deflection than the inwardly bent contact front portions. In other words, the contact area of the cut-out contact tongues extends further into the interior of the box-shape than the contact area of the contact front portions. This arrangement is in particular preferred in connection with the concept of different contact forces described in the preceding paragraph.

The inventive contact terminal is preferably a one piece construction (i.e. without any additional holding cage surrounding the pin reception member) obtained by bending a piece of sheet metal into the four-wall box-shape. In combination with the locking tongue and the locking aperture provided on two of the walls the box-shape is stable without any necessity for additional welding operations or additional holding parts. The mechanical stability can be advantageously increased by folding the free end of the locking tongue around one edge of the aperture it is inserted through. Thereby, it is no longer possible to "unfold" the box-shape.

4. DESCRIPTION OF THE PREFERRED EMBODIMENTS

In the following, the invention is described exemplarily with reference to the enclosed figures, in which.

Figure 1:
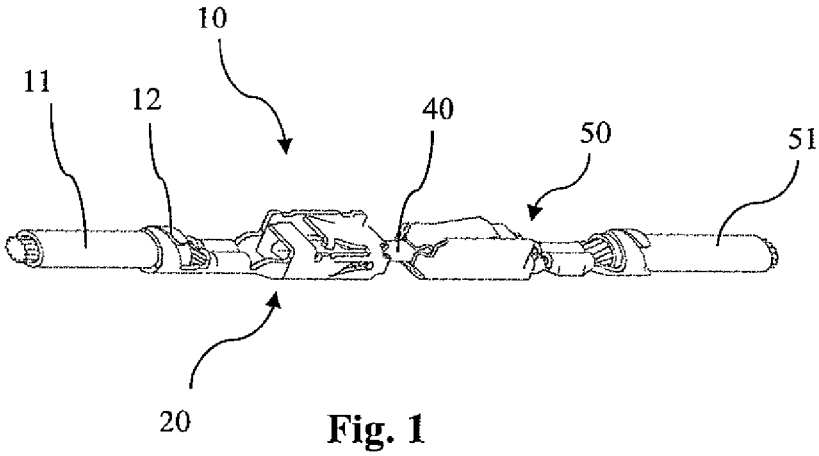
FIG. 1 is a schematic illustration of a contact terminal in accordance with the invention being connected to a corresponding prior art terminal.

FIG. 1 shows a schematic view of a contact terminal 10 according to the invention being coupled via a contact pin 40 to a prior art terminal 50. In the embodiment shown in FIG. 1, the inventive terminal 10 serves as a female terminal, i.e. a terminal adapted to receive a contact pin upon coupling. Reference numbers 11 and 51 denote cables attached to the contact terminals. The terminal 10 comprises crimping wings 12 being bent over the insulating of cable 11. However, also other means for mounting of cable 11 are equally feasible, as for example welding. The terminal further comprises a pin reception member 20 with a four-wall box-shape, which is bent from a single piece of sheet metal.

Figure 2:
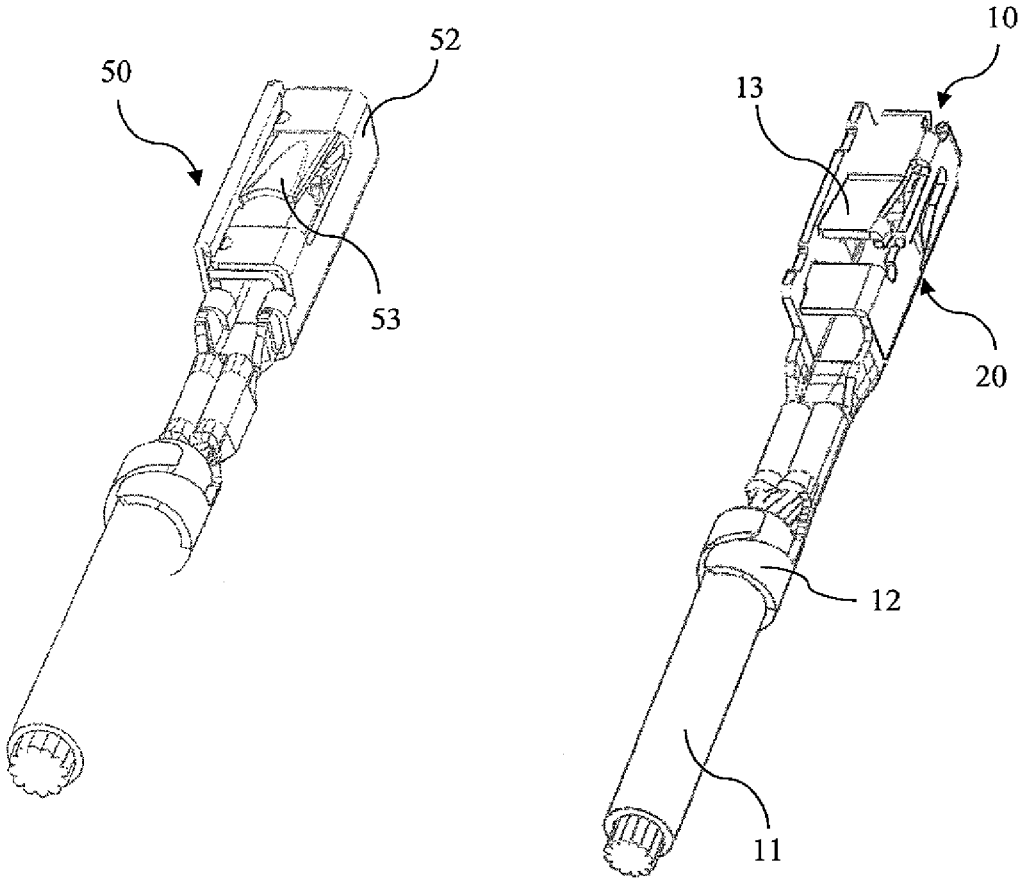
FIG. 2 shows the inventive terminal next to a prior art terminal.

FIG. 2 shows the inventive terminal 10 (on the right) next to the prior art terminal 50 of FIG. 1 in an enlarged schematic view. The prior art terminal 50 is further provided with an additional holding cage 52, which is clamped around the pin reception part of the terminal, for an additional strengthening of the pin reception part and to serve as a fastening means of the terminal inside of a connector housing by means of a locking vane 53. Also the inventive terminal 10 is provided with a locking pawl 13, which is, however, integrally formed with one of the walls of the terminal. Due to a construction later on described in more detail, the inventive terminal 10 does not need any additional holding cage as one can see from the figures.

Figure 3A:
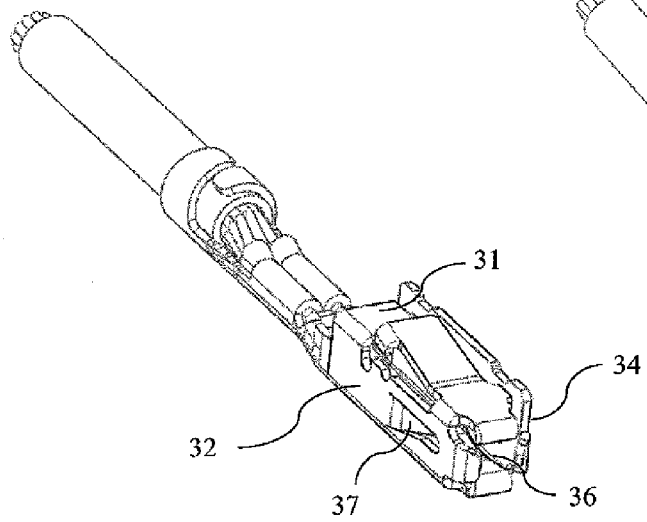
FIG. 3A to 3B show two different perspective schematic views of the inventive contact terminal of FIGS. 1 and 2.
Figure 3B:
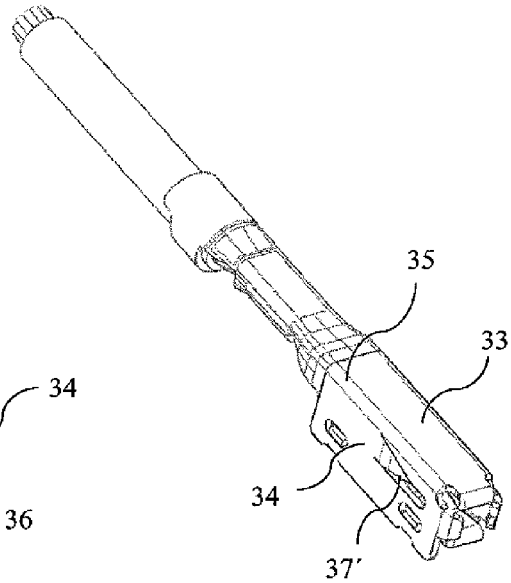

FIG. 3 shows two different perspectives of the inventive terminal 10. As one can clearly see from FIGS. 3A and B, the pin reception member having the four-wall box-shape is made from a first wall 31, a second wall 32, a third wall 33 and fourth wall 34. First and fourth wall are bent into mutual contact with each other, however, they are not connected by a common, integrally bending edge as it is the case with first and second wall, second and third wall and third and fourth wall. In FIG. 3B such a common, integrally bending edge between third 33 and fourth 34 walls is denoted by reference numeral 35. The pin reception member 20 has an opening 36 for the insertion of a contact pin. The opposite end of the box-shape is also open, although this is not strictly necessary but rather derives from the production process. Each one of the second and the fourth walls comprises a cut-out contact tongue 37, 37', which is inwardly bent into the interior of the box-shape. As one can see from the figures, both contact tongues are provided in form of elastic spring arms and are formed from u-shaped cut-outs in the second and fourth walls such that their respective free ends are directed in a direction which is opposite to the reception direction of the pin reception member. In other words, the free ends of the contact tongues 37, 37' point towards the pin reception opening 36. Likewise, the first and the third walls 31 and 33 are provided with further contact elements in the form of contact front portions, which are inwardly bent as one can best derive from FIG. 4. The contact front portions are denoted with the reference numerals 38, 38'.

Figure 4:
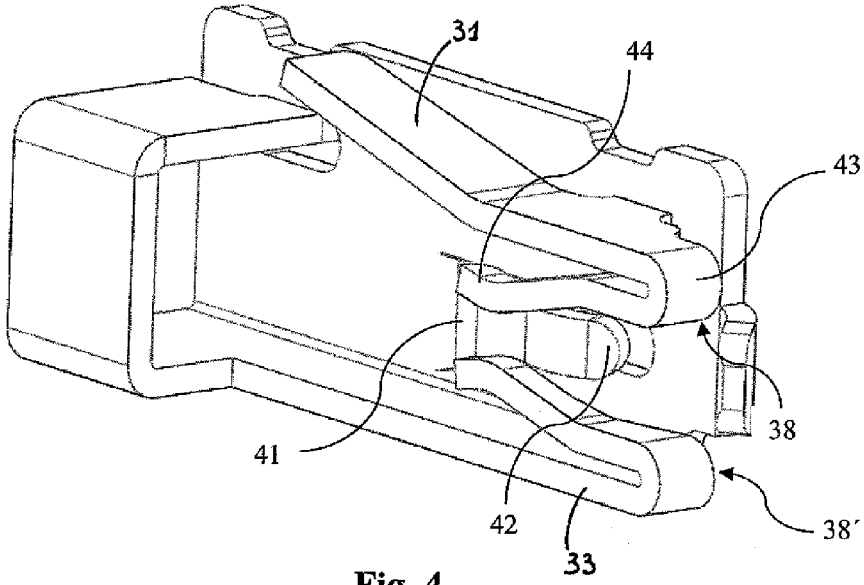
FIG. 4 shows a cut-sectional view of a detail of the inventive terminal.

From FIG. 4 it can best be derived that both contact front portions 38, 38' are inwardly bent, such that the respective walls 31 and 33 have essentially a hook-shaped cross-section. Contact front portions 38 and 38' are provided in form of elastic spring arms, extending from a base portion 43 integrally formed with the respective wall and the free ends 44 being arranged inside of the pin reception member. However, the free ends of front portions 38 and 38' are directed in the reception direction of the pin reception member. Also the contact tongues 37, 37' are provided in form of elastic spring arms, extending from a base portion 41 integrally formed with the respective wall and the free ends 42 thereof being arranged inside of the pin reception member. The skilled person will notices, that upon insertion of a suitable contact pin, the same will be held by all four of the "contact" elements 37, 37', 38 and 38'. All four of these elements can therefore be considered as "spring arms".

Figure 5:
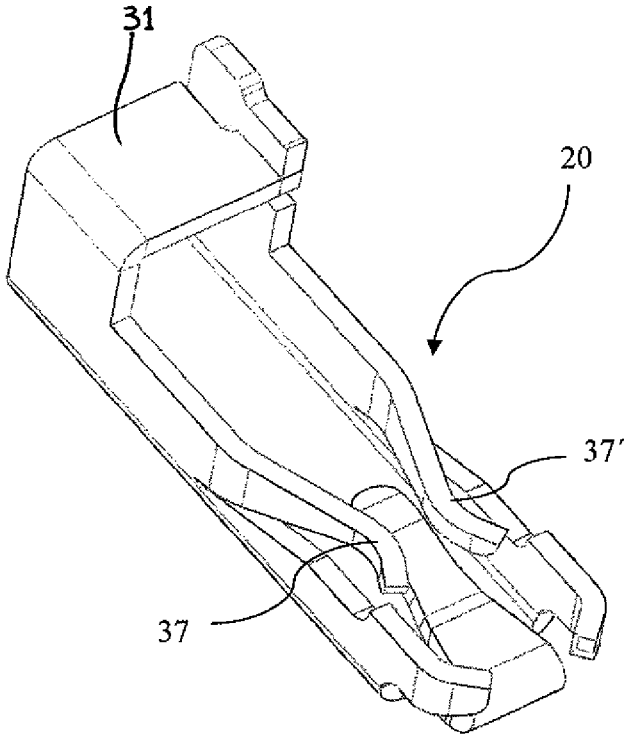
FIG. 5 shows another cut-sectional detail of the inventive terminal.

FIG. 5 is another cut-sectional view of the pin reception member 20. The form and shape of contact tongues 37 and 37' can be seen and one can see that the contact area thereof, i.e. the area of the contact tongues extending farthest into the interior of the reception member and being therefore the first part of the tongues coming into contact with a contact pin, are provided with a larger spring deflection than the contact front portions 38 and 38'. Since the contact area of contact tongues 37, 37' is closer to the opening 36 than the contact area of the front portions 38 and 38', a pin being inserted into the opening 36 will first come into contact with the contact tongues 37, 37', before it will come into contact with the contact front portions 38, 38'. The spring deflection of tongues 37 and 37' is larger than the spring deflection front portions 38 and 38' and the mechanical resistance against the movement of the contact pin is lower when exerted by the contact tongues than when exerted by the contact front portions. This significantly facilitates the insertion of contact pins, in particular in combination with connector arrangements having a large number of contacts, which have to be simultaneously connected upon closing of the connector. It is believed that the "softer" contacting and holding force of the contact tongues 37, 37' facilitates the initial insertion of the pin into the pin reception member so that when the pin reaches the contact area of the more rigid front portions the pin is already well guided inside of the reception member and it is thus easier to overcome the resistance offered by the front portions without an unwanted deflection of the contact pin.

Another important finding of the present invention is that the contact elements should be arranged symmetrical on opposing walls of the reception member. In other words, and as one can see from the figures, elements 37 and 37' are identical to each other and arranged symmetrical with regard to the pin insertion direction and the same is also the case for the front portions 38 and 38'.

Figure 6:
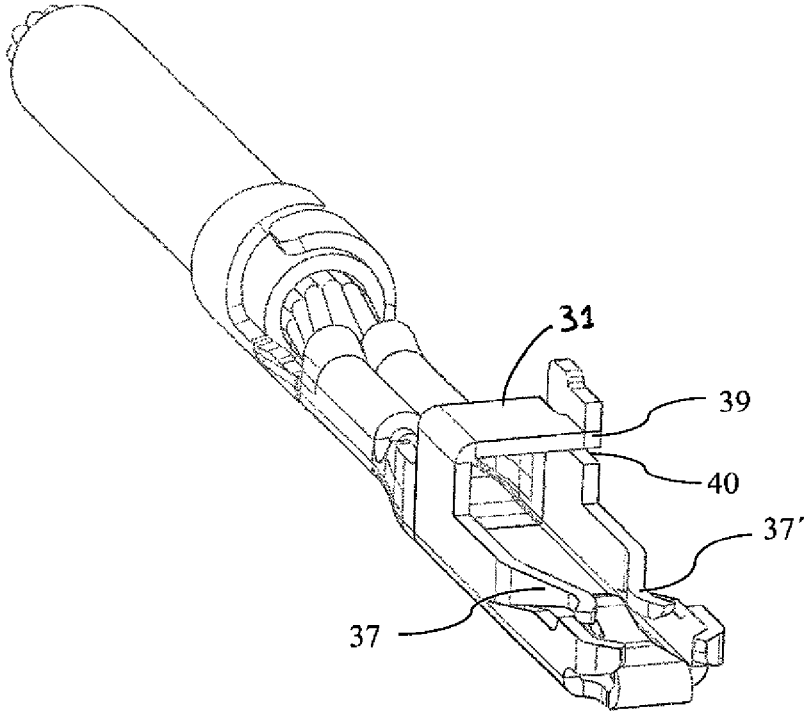
FIG. 6 shows the detail of FIG. 5 from a different perspective.

As one can best derive from FIGS. 5 and 6, the first wall 31 is further provided with a locking tongue 39 protruding from the free edge of the first wall and the fourth wall 34 comprises a corresponding aperture 40. Since first and fourth wall are arranged perpendicular to each other to close the box design, the locking tongue 39 extends through the aperture 40 to prevent an unintentional opening of the box upon insertion of a contact pin. Due to this mechanical construction no welding points are necessary to hold the box together, which makes the assembly process more economic. The locking function of tongue 39 can further be improved by providing the tongue 39 so that it extends to some amount through aperture 40, and that its free end can be folded around one of the edges of aperture 40.

Figure 7:
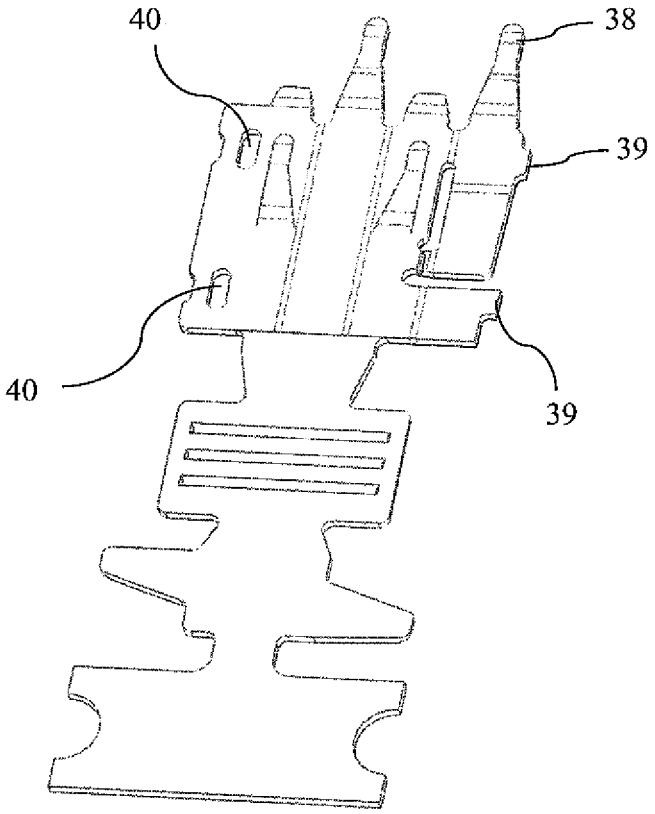
FIG. 7 shows a blank part of the terminal before bending.

FIG. 7 shows a view of a blank part of the terminal described herein. This blank part is further provided with reference numbers and the skilled person will recognize that upon correct bending of this part the construction shown in FIGS. 1 to 6 will derive.

Figure 8:
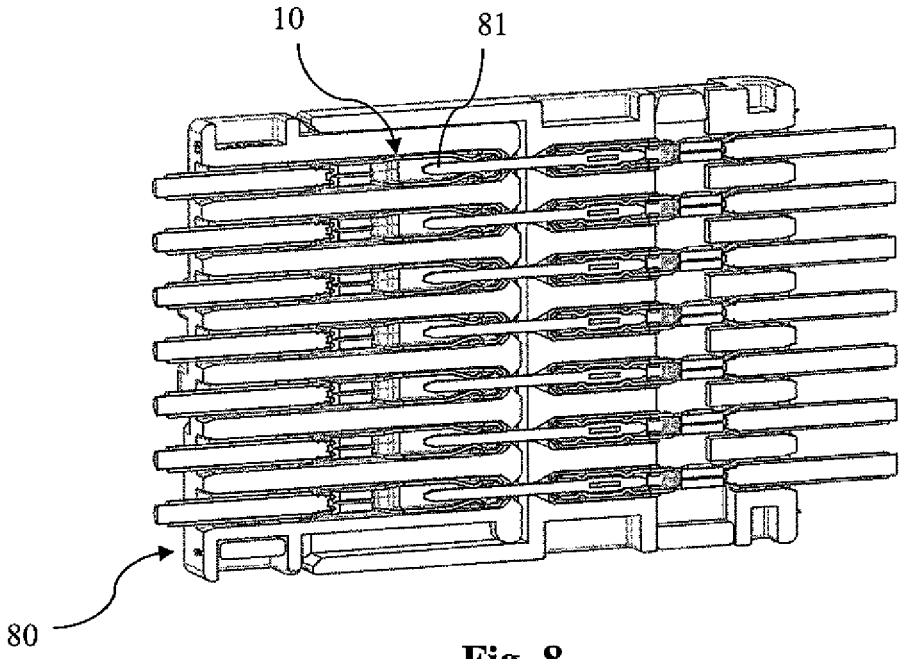
FIG. 8 shows the inventive terminal assembled inside of a connector housing.

FIG. 8 shows exemplarily a connector 80 comprising a connector housing holding a number of inventive contact terminals 10 in accordance with the construction shown in FIGS. 3 to 7. In each terminal 10 a contact pin 81 is inserted when a counterpart connector 82 is mated with the connector 80.

The invention claimed is:

1. Contact terminal for the reception of contact pins, comprising:

a pin reception member having a box-shape made from a single piece of sheet metal, wherein two opposite walls comprise each at least one cut-out contact tongue being inwardly bent into the interior of the box-shape, characterized in that two other opposite walls comprise each a contact front portion which is inwardly bent such that the respective wall has essentially a hook-shaped cross-section; and in that one wall of the pin reception member comprises at least one aperture and another wall comprises at least one locking tongue, which in the assembled condition of the pin reception member is arranged at least partially in said aperture, wherein the inwardly bent contact front portions and the inwardly bent cut-out contact tongues are adapted to provide contact surfaces for a contact pin.

2. Contact terminal according to claim 1, wherein the contact front portions and the cut-out contact tongues are provided in form of elastic spring arms.

3. Contact terminal according to claim 1, whereby the contact front portions are symmetrical with respect to each other and the cut-out contact tongues are symmetrical with respect to each other.

4. Contact terminal according to claim 1, wherein the contact front portions and the cut-out contact tongues are each formed as an elastic spring arm which extends from a base portion integrally formed with the respective wall of the pin reception member and the respective free ends are arranged inside of the interior of the box-shape of the pin reception member, such that upon insertion of a contact pin the same is held by the four elastic spring arms.

5. Contact terminal according to claim 4, wherein the free ends of the contact front portions are directed in the reception direction of the pin reception member and the free ends of the cut-out contact tongues are directed in the opposite direction.

6. Contact terminal according to claim 1, wherein the respective spring deflection of the cut-out contact tongues is larger than the respective spring deflection of the inwardly bent contact front portions.

7. Contact terminal according to claim 1, wherein upon insertion of a contact pin, the contact force applied by the pair of cut-out contact tongues and the contact force applied by the pair of contact front portions is different from each other and that the pair with the lower contact force is arranged at the pin reception member such that the contact surfaces of this pair are closer to the pin receiving opening of the pin reception member than the contact surfaces of the other pair.

8. Contact terminal according to claim 7, wherein the cut-out contact tongues apply a lower contact force than the contact front portions.

9. Contact terminal according to claim 1, wherein the box-shape of the pin reception member is formed by at least first, second, third and fourth walls being folded to form a four-wall box, whereby the first and the second walls are arranged perpendicular to each other to close the box and whereby the first wail comprises the at least one locking tongue protruding from the free edge of the first wall and the fourth wall comprises the at least one aperture.

10. Contact terminal according to claim 9, wherein the locking tongue extends through the aperture and the free end of the tongue is folded around one edge of the aperture.

11. Contact terminal according to claim 9, wherein the first wall is arranged perpendicular to the fourth wall and the fourth wall extends outwardly perpendicular from the plane of the first wall.

12. Contact terminal according to claim 1, wherein the box-shape of the pin reception member is achieved without the necessity for welding spots.

13. Contact terminal according to claim 1, wherein the terminal does not comprise nor need any additional holding cage around the pin reception member.

* * * * *